US007448737B2

(12) United States Patent
Takagi

(10) Patent No.: US 7,448,737 B2
(45) Date of Patent: Nov. 11, 2008

(54) INK JET RECORDING APPARATUS

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 437 days.

(21) Appl. No.: 11/363,155

(22) Filed: Feb. 28, 2006

(65) Prior Publication Data

US 2006/0192823 A1 Aug. 31, 2006

(30) Foreign Application Priority Data

Feb. 28, 2005 (JP) ..... 2005-054719

(51) Int. Cl.
*B41J 2/175* (2006.01)

(52) U.S. Cl. ..... 347/85

(58) Field of Classification Search ..... 347/84, 347/85; 141/2, 18
See application file for complete search history.

(56) References Cited

U.S. PATENT DOCUMENTS 4,999,651 A * 3/1991 Duffield et al. ..... 347/3
6,059,405 A * 5/2000 Mochizuki et al. ..... 347/92
6,139,136 A * 10/2000 Mackay et al. ..... 347/85
6,281,916 B1 * 8/2001 VanSteenkiste ..... 347/85
6,386,689 B1 * 5/2002 Sasada ..... 347/85
6,481,836 B1 * 11/2002 Paroff et al. ..... 347/85
6,481,838 B1 11/2002 Brugue et al.

FOREIGN PATENT DOCUMENTS

| | | |
|---|---|---|
| EP | 1449664 A2 | 8/2004 |
| JP | 6746 | 1/1994 |
| JP | WO9962718 | 12/1999 |
| JP | 2002200768 | 7/2002 |
| JP | 2002240316 | 8/2002 |

OTHER PUBLICATIONS

European Search Report (4 pages) in corresponding European patent application.

* cited by examiner

*Primary Examiner*—Anh T. N. Vo
(74) *Attorney, Agent, or Firm*—Baker Botts L.L.P.

(57) ABSTRACT

An ink jet recording apparatus is arranged in which the loading and unloading of ink cartridges as well as the supply and removal of a recording medium is carried out at the upstream side in a conveying direction. The ink tubes for connecting ink dispensing outlets and ink dispensing inlets are positioned so that they are substantially uniform in the length thus to have no difference in the resistance to flows.

13 Claims, 5 Drawing Sheets

INK JET RECORDING APPARATUS

CROSS-REFERENCE TO RELATED APPLICATIONS

This Nonprovisional application claims priority under 35 U.S.C. §119(a) on Patent Application No. 2005-054719 filed in Japan on Feb. 28, 2005, the entire contents of which are hereby incorporated by reference.

BACKGROUND

The present invention relates to an ink jet recording apparatus and more specifically to an ink jet recording apparatus capable of improving the user friendly function while avoiding deterioration of the image quality.

Ink jet recording apparatuses for ejecting ink onto a recording medium to form a desired image are classified into substantially two types: a serial type ink jet recording apparatus equipped with a recording head arranged movable in one direction and a line type ink jet recording apparatus equipped with a stationary recording head.

One of serial type ink jet recording apparatuses is disclosed in Japanese Patent Application Laid-open No. 2002-240316 where its ink jet (recording) heads are supplied with ink via flexible ink tubes from ink cartridges. This allows the ink tubes to be easily bent as the ink jet heads move.

On the other hand, a conventional line type ink jet recording apparatus is equipped with stationary recording heads and needs no such flexibility of the ink tubes as required in a serial type ink jet recording apparatus. The ink tubes can be used of which the wall is thick enough to improve the resistance to permeation of gas or liquid and thus permit no deterioration of the ink quality.

SUMMARY

However, as the ink tubes of the conventional serial type ink jet recording apparatus need to be flexible, they have to be made of a highly elastic material or be minimized in the wall thickness. As the result, their resistance to permeation of gas or liquid will be declined thus deteriorating the quality of the ink.

Also, it has been demanded for improving the user friendly function of the line type ink jet recording apparatus to conduct both the loading and unloading of ink cartridges and the supplying of a recording medium at one side of the apparatus (for example, the near side of the recording apparatus). For fulfilling the demand, for example, a technique may be proposed to have the recording heads aligned in the direction of conveying and the ink cartridges aligned in a direction substantially at a right angle to the conveying direction.

However as the recording heads and the ink cartridges are arranged in the above relationship, their distance between each pair will hardly be uniform. Accordingly, the ink tubes will be varied in the length thus causing a declination in the image quality.

Therefore, in order to solve the above problem and its object is to provide an ink jet recording apparatus capable of improving the user friendly function and simultaneously permitting no deterioration of the image quality.

For achievement of the object, an ink jet recording apparatus according to the first aspect is an ink jet recording apparatus comprising: a conveying unit for conveying a recording medium in a first direction; a plurality of recording heads positioned to face the recording medium being conveyed by the conveying unit, each of the recording heads having a plurality of ink ejecting holes and an ink dispensing inlet provided therein from which ink is supplied; a plurality of cartridge loading units into which corresponding ink cartridges are loaded from the outside; a plurality of ink dispensing units provided corresponding to the cartridge loading units, each of the ink dispensing units having an ink dispensing outlet for dispensing the ink from the corresponding ink cartridge loaded in the cartridge loading unit; and a plurality of ink tubes for connecting the ink dispensing outlets and the ink dispensing inlets respectively, wherein the recording heads are arranged so that their ink dispensing inlets are aligned in the first direction, the cartridge loading units are aligned in a second direction, which extends substantially at a right angle to the first direction, so that their corresponding ink cartridges are inserted and loaded in the first direction, the ink dispensing units are arranged with their ink dispensing outlets aligned in the second direction, and the ink dispensing inlets communicated with the corresponding ink dispensing outlets are arranged so that one ink dispensing inlet is located further from the intersecting point between the line along which the ink dispensing inlets are aligned and the line along which the ink dispensing outlets are aligned than the another ink dispensing inlet communicated with the ink dispensing outlet which is distanced further from the intersecting point than the ink dispensing outlet communicated with the one ink dispensing inlet.

In the ink jet recording apparatus according to the first aspect, the recording heads are aligned in the first direction in which the recording medium is conveyed and the cartridge loading units are aligned in the second direction which extends substantially at a right angle to the first direction and allows their respective ink cartridges to be loaded in the first direction. Accordingly, as the apparatus permits each user to supply the recording medium and load or unload the ink cartridges at the one side in the first direction, its user friendly function can be improved.

Also, the ink dispensing inlets provided in the corresponding recording heads for feeding the ink are aligned in the first direction while the ink dispensing units provided with the ink dispensing outlets are aligned in the second direction for dispensing the ink from the ink cartridges loaded in their respective cartridge loading units. While the ink dispensing inlets and the ink dispensing outlets are connected respectively by the ink tubes, one ink dispensing inlet is located further from the intersecting point between the line along which the ink dispensing inlets are aligned and the line along which the ink dispensing outlets are aligned than the another ink dispensing inlet communicated with the ink dispensing outlet which is distanced further from the intersecting point than the ink dispensing outlet communicated with the one ink dispensing inlet. This allows the ink tubes to be substantially uniform in the length and thus in the resistance to flows. As the result, the recording heads can be uniform in the shape and the location of the meniscus developed at their ink ejecting holes, hence permitting no deterioration of the image quality.

The above and further objects and features will more fully be apparent from the following detailed description with accompanying drawings.

DETAILED DESCRIPTION OF THE EXEMPLARY EMBODIMENTS

Figure 1:
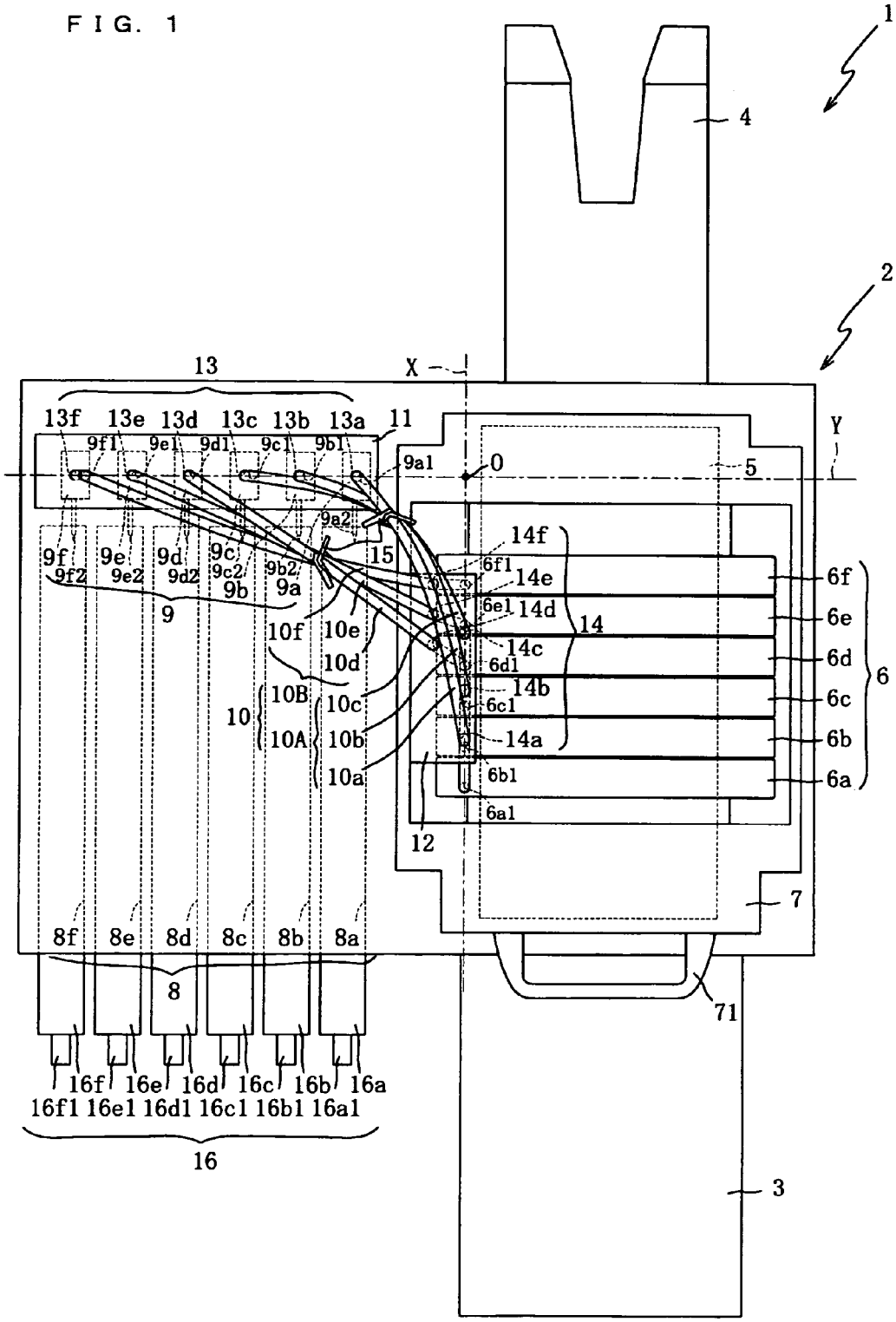
FIG. 1 is a top view of an ink jet recording apparatus according to the first embodiment.

Preferred embodiments are described below with reference to the accompanying drawings. FIG. 1 is a top view of an ink jet recording apparatus 1 according to the first embodiment. The description starts from the overall arrangement of the ink jet recording apparatus 1 with reference to FIG. 1.

The ink jet recording apparatus 1 comprises a supply unit 3 (recording medium supplying unit) for supplying a recording medium (not shown), a main body 2 for forming an image on a recording medium supplied from the supply unit 3, and a stacker 4 for stocking the recording medium on which the image is formed by the main body 2.

The supply unit 3 includes a tray (not shown) for accommodating the recording medium and a pickup roller (not shown) for coming into contact with the recording medium accommodated in the tray. The supply unit 3 is designed for supplying the recording medium to the main body 2 when actuating the pickup roller. A new recording medium is loaded into the supply unit 3 from the front side, or near side of the main body 2 (the lower side in FIG. 1).

The main body 2 comprises a conveyance belt 5 (conveying unit) for conveying the recording medium from the supply unit 3, six recording heads 6 (6*a* to 6*f*) for ejecting ink onto the recording medium conveyed on the conveyance belt 5 to form an image, a head unit 7 to which the recording heads 6 are mounted, cartridge loading units 8 (8*a* to 8*f*) into which six ink cartridges 16 (16*a* to 16*f*) are loaded from the near side of the main body 2 (the lower side in FIG. 1), ink dispensing units 9 (9*a* to 9*f*) joined with their respective ink cartridges 16 held in the cartridge loading units 8 for dispensing ink from the ink cartridges 16, and six, first to sixth, ink tubes 10 (10*a* to 10*f*) for feeding the ink from the ink dispensing units 9 to the recording heads 6. Also, a first tube holder 11 is mounted above the ink dispensing units 9*a* to 9*f* at their ink dispensing outlets 9*a*1 to 9*f*1 (the near side along the vertical to the sheet surface of FIG. 1) while a second tube holder 12 is mounted above the recording heads 6*a* to 6*f* at their ink dispensing inlets 6*a*1 to 6*f*1.

The conveyance belt 5 is wound around a pair of driving rollers 51*a* and 51*b* (See FIG. 2) for conveying the recording medium from the supply unit 3 to the stacker 4. The retaining surface, or the periphery surface of the conveyance belt 5 on which the recording medium is conveyed is subjected to silicon treatment to secure an adhesion force. This allows the recording medium to be conveyed from the upstream side (the lower side in FIG. 1) where it is pressed down against the conveyance belt 5 by a nip roller (not shown) to the downstream side (the upper side in FIG. 1) by the rotating action of the driving roller 51*b* while being retained by the adhesion force. The first direction is equal to a direction (the vertical direction in FIG. 1) of conveying the recording medium on the conveyance belt 5 in this embodiment.

The recording heads 6*a* to 6*f* corresponding to the ink cartridges 16*a* to 16*f* are fixedly mounted to the head unit 7 so that their longitudinal direction is the width direction (the horizontal direction in FIG. 1) of the conveyance belt 5 and are aligned in the first direction. The number of the recording heads 6 is not limited to six but may be greater or smaller than six.

The recording heads 6*a* to 6*f* have ink ejecting holes (not shown) provided on their surfaces facing the conveyance belt 5 for ejecting the ink. As the recording medium is passed beneath the ink ejecting holes on the conveyance belt 5, its upper or image recording surface receives drops of the ink from the recording heads 6*a* to 6*f* for forming a desired image thereon.

The hollow tubular ink dispensing inlets 6*a*1 to 6*f*1 provided in ends of their respective recording heads 6*a* to 6*f* on the ink cartridge 16 side (the left side in FIG. 1) extend upwardly (the near side along the vertical to the sheet surface of FIG. 1). With their respective ink dispensing inlets 6*a*1 to 6*f*1 connected with the first to sixth ink tubes 10*a* to 10*f*, the recording heads 6*a* to 6*f* communicate with their corresponding ink cartridges 16*a* to 16*f*. In particular, the ink dispensing inlets 6*a*1 to 6*f*1 are aligned along a first imaginary line X (the line along which the ink dispensing inlets are aligned) which extends in parallel with the first direction as shown in FIG. 1.

Since the ink dispensing inlets 6*a*1 to 6*f*1 are provided on ends of their respective recording heads 6*a* to 6*f* on the ink cartridge 16 side, their distance from the ink dispensing outlets 9*a*1 to 9*f*1, as described later, of the ink dispensing units 9*a* to 9*f* is minimized. This allows the ink tubes 10*a* to 10*f* to be shortened and thus reduced in the material cost.

The head unit 7 is arranged so as to be turnable in relation to the main body 2 about a shaft which extends in a second direction (the horizontal direction in FIG. 1) perpendicular to the first direction (the vertical direction in FIG. 1) and is located on one end of ends in the first direction which is close to a second imaginary line Y as described later (the downstream side in the conveying direction of the recording medium, upper side in FIG. 1).

More specifically, the head unit 7 in this embodiment is pivotably supported on the one end at the downstream side (the upper side in FIG. 1) in the conveying direction so as to be turnable by the main body 2 and has a handle 71 provided on the other end (the lower side in FIG. 1) thereof. This allows the head unit 7 to be turned open from the near side (the lower side in FIG. 1) of the main body 2 for removing jammed paper or the like.

The cartridge loading units 8 are provided on one side of the recording heads 6 (the left side in FIG. 1) for loading their respective ink cartridges 16 where different ink is stored. More specifically, the first to sixth cartridge loading units 8*a* to 8*f* corresponding to the recording heads 6*a* to 6*f* are aligned in the second direction (the horizontal direction in FIG. 1). The first to sixth cartridge loading units 8*a* to 8*f* have openings provided on the near side of the main body 2 from which their respective ink cartridges 16*a* to 16*f* are inserted in the first direction on the near side of the main body 2.

As the result, the supply of the recording medium, the jamming process, and the loading and unloading of the ink cartridges 16*a* to 16*f* can all be conducted on the near side of the main body 2, hence contributing to the improvement of the user friendly function.

Also, the ink cartridges 16*a* to 16*f* have grips 16*a*1 to 16*f*1 provided on one longitudinal ends (the lower side in FIG. 1) thereof respectively for ease of the loading and unloading on the cartridge loading units 8.

The ink dispensing units 9 are provided for dispensing the ink from the ink cartridges 16 to the corresponding recording heads 6. With their hollow tubular ink dispensing outlets 9*a*1 to 9*f*1 extending upwardly, the ink dispensing units 9 also have dispensing needles 9*a*2 to 9*f*2 thereof arranged to extend into the corresponding, first to sixth, cartridge loading units 8*a* to 8*f*. The dispensing needles 9*a*2 to 9*f*2 pierce the corresponding ink cartridges 16*a* to 16*f* loaded in their respective cartridge loading units 8*a* to 8*f*, hence allowing the ink to be fed from the ink cartridges 16*a* to 16*f*.

The ink dispensing unit 9 is preferably equipped with a pump which can exert a pressure on the ink for feeding from the ink cartridge 16 into the recording head 6. Accordingly, even when the ink dispensing inlets 6*a*1 to 6*f*1 are located higher (the near side along the vertical to the sheet surface of FIG. 1) than the ink dispensing outlets 9*a*1 to 9*f*1, they can receive the ink without insufficiency.

The ink dispensing outlets 9*a*1 to 9*f*1 are configured for communication with the corresponding ink tubes 10 to feed the ink through the hollow tubular inside. In particular, the ink dispensing outlets 9*a*1 to 9*f*1 are aligned along the second imaginary line Y (the line along which the ink dispensing outlets are aligned) which extends in parallel with the second direction as shown in FIG. 1. In other words, the alignment of the ink dispensing outlets 9*a*1 to 9*f*1 is perpendicular to the alignment of the ink dispensing inlets 6*a*1 to 6*f*1.

The dispensing needles 9*a*2 to 9*f*2 are made of hollow tubular needle-shaped materials which penetrate sealing materials fitted in the ink feeding outlets of the ink cartridges 16*a* to 16*f* for communicating the ink dispensing units 9*a* to 9*f* with the corresponding ink cartridges 16*a* to 16*f*.

The ink tubes 10 are provided for feeding the ink from the ink cartridges 16 into the corresponding recording heads 6. When the number of the ink dispensing inlets 6 or the ink dispensing outlets 9 is n (n being a natural number of two or more), the x-th ink dispensing outlet 9 (x being a natural number) from the intersecting point O between the first imaginary line X and the second imaginary line Y is communicated with the (n−x+1)th ink dispensing inlet 6 from the intersecting point O.

More specifically, as the number of the ink dispensing inlets 6 or the ink dispensing outlets 9 is six (n=6) in this embodiment, the first ink tube 10*a* connected to the first ink dispensing outlet 9*a*1 which is the closest to the intersecting point O is joined to the first ink dispensing inlet 6*a*1 which is the sixth closest to the intersecting point O. Similarly, the second ink tube 10*b* connected to the second ink dispensing outlet 9*b*1 which is the second closest to the intersecting point O is joined to the second ink dispensing inlet 6*b*1 which is the fifth closest to the intersecting point O. As their communicated ink dispensing outlets 9 are distanced further from the intersecting point O, the ink tubes 10 are joined to the corresponding ink dispensing inlets 6 closer to the intersecting point O. Finally, the sixth ink tube 10*f* connected to the sixth ink dispensing outlet 9*f*1 which is the sixth closest to the intersecting point O is joined to the sixth ink dispensing inlet 6*f*1 which is the closest to the intersecting point O.

The communication by the ink tubes 10*a* to 10*f* between the ink dispensing outlets 9*a*1 to 9*f*1 and the ink dispensing inlets 6*a*1 to 6*f*1 is defined by one of the ink dispensing inlets 6*a*1 to 6*f*1 communicated with the corresponding ink dispersing outlet 9 remaining located further from the intersecting point O than the another ink dispersing inlet 6 communicated with the corresponding ink dispensing outlet 9 which is distanced further from the intersecting point O than the ink dispensing outlet 9 communicated with the one ink dispensing inlet.

As apparent from FIG. 1, by joining the ink tubes 10 as described above, this allows the ink tubes 10*a* to 10*f* to remain minimized in the difference of the length when the ink dispensing outlets 9*a*1 to 9*f*1 are aligned at a right angle to the alignment of the ink dispensing inlets 6*a*1 to 6*f*1. Accordingly, the ink tubes 10*a* to 10*f* can substantially be uniform in the resistance to flow, thus making the corresponding recording heads 6*a* to 6*f* uniform in both the shape and the location of the meniscus developed at their ink ejecting holes (not shown) and permitting no deterioration of the image quality.

Also, the ink tubes 10*a* to 10*f* can be manufactured uniform but not different in the length for connecting the ink dispensing outlets 9*a*1 to 9*f*1 and the ink dispensing inlets 6*a*1 to 6*f*1, thus reducing the production cost.

Moreover, as no troublesome action of the worker selecting the ink tubes 10*a* to 10*f* of different lengths for respectively connecting the ink dispensing outlets 9*a*1 to 9*f*1 and the ink dispensing inlets 6*a*1 to 6*f*1 is needed, the overall working efficiency can be increased.

The material of the ink tubes 10 in this embodiment is higher in the rigidity and greater in the thickness than that employed in any serial type ink jet recording apparatus. Accordingly, their resistance to permeation of gas or liquid can be improved thus preventing deterioration of the ink quality.

As shown in FIG. 1, the three, first, second, and third, ink tubes 10*a*, 10*b*, 10*c* are bound to a tube group 10A by a binder 15 while the other, fourth, fifth, and sixth, ink tubes 10*d*, 10*e*, 10*f* are bound to another tube group 10B by a binder 15. Since the two tube groups 10A and 10B are distanced from each other, their interference to each other can be avoided thus permitting no injury or detachment of the ink tubes 10 from the ink dispensing outlets 9 or the ink dispensing inlets 6.

Also, the three ink tubes 10 in each of the groups 10A and 10B are arranged to overlap one another so that one tube 10 with its communicated ink dispensing inlet 6 closer to the intersecting point O remains lower (the far side along the vertical to the sheet surface of FIG. 1) than the other. More particularly, the three ink tubes 10*a*, 10*b* and 10*c* in the tube group 10A overlap one another from the top to the bottom in this order while the other three ink tubes 10*d*, 10*e* and 10*f* in the tube group 10B overlap one another from the top to the bottom in this order. This prevents the lower ink tube 10 from pushing up the upper ink tube(s) 10 when the head unit 7 is turned up (See FIG. 3), hence inhibiting the ink tubes 10*a* to 10*f* from being detached from the corresponding ink dispensing outlets 9*a*1 to 9*f*1 and the corresponding ink dispensing inlets 6*a*1 to 6*f*1 and contributing to the smooth turning movement of the head unit 7.

For the described purpose, the tube group 10B of which the three tubes 10*d* to 10*f* are communicated to the corresponding ink dispensing inlets 6*d*1 to 6*f*1 located closer to the intersecting point O is held lower than the tube group 10A.

Preferably, the binder 15 is positioned close to the point where the three ink tubes 10*a* to 10*c* or 10*d* to 10*f* overlap each other spontaneously when remain not bound. This allows the ink tubes 10*a* to 10*f* to remain less stressed when the head unit 7 is turned up, hence contributing to the smooth turning movement of the head unit 7.

The first tube holder 11 is made of a plate member located above the ink dispensing units 9 (the near side along the vertical to the sheet surface of FIG. 1) and having six first through holes 13*a* to 13*f* provided therein for holding the six ink tubes 10*a* to 10*f* respectively. Since the ink tubes 10*a* to 10*f* remain held in the corresponding first through holes 13*a* to 13*f*, they are physically spaced from one another. Accordingly, the ink tubes 10*a* to 10*f* can be prevented from interfering with one another, hence suffering from no physical injury. Also, the meniscus developed at the ink ejecting holes of each recording head 6 can hardly be fractured.

The first through hole 13*f* for holding the sixth ink tube 10*f* which is communicated with the sixth ink dispensing outlet 9*f*1 is inclined with its upper opening (the near side along the vertical to the sheet surface of FIG. 1) located closer to the intersecting point O or the recording heads 6 (the right side in FIG. 1) than its lower opening. This allows the sixth ink tube 10*f* held in the first through hole 13*f* to remain tilted towards the recording heads 6. Accordingly, the sixth ink tube 10*f* can span at a lower position without being bent, thus contributing to the minimum height of the main body 2.

In this embodiment, the other first through holes 13*a* to 13*e* are arranged to extend substantially in parallel with the longitudinal direction (along the vertical to the sheet surface of FIG. 1) of the first to fifth ink dispensing units 9*a* to 9*e* but not intended to be so limited. The other first through holes 13*a* to 13*e* may be inclined with their upper openings located closer to the recording heads 6 than their lower openings.

Also, the first through hole 13*f* is inclined with its upper opening located closer to the recording heads 6 than its lower opening but not intended to be so limited. The first through hole 13*f* may be inclined with its upper opening located on an imaginary line which extends between the first through hole 13*f* and a second through hole 14*f* provided in a second tube holder 12 as will be described later. This allows the sixth ink tubes 10*f* held in the first through hole 13*f* to be tilted towards the second through hole 14*f* and thus span at a lower position without being bent, thus contributing to the minimum height of the main body 2. Alternatively, the other first through holes 13*a* to 13*e* may be arranged in the same manner.

The second tube holder 12 is similarly made of a plate member located above the ink dispensing inlets 6 (the near side along the vertical to the sheet surface of FIG. 1) and having six second through holes 14*a* to 14*f* provided therein for holding the six ink tubes 10*a* to 10*f* respectively. Since the ink tubes 10*a* to 10*f* remain held in the corresponding second through holes 14*a* to 14*f*, they are physically spaced from one another. Accordingly, the ink tubes 10*a* to 10*f* can be prevented from interfering with one another, hence suffering from no physical injury and permitting no fracture of the meniscus.

The second through holes 14*a* to 14*c* in the second tube holder 12 for holding the first to three ink tubes 10*a* to 10*c* have their lower openings (the far side along the vertical to the sheet surface of FIG. 1) located closer to the intersecting point O (the upper side in FIG. 1) than the corresponding ink dispensing inlets 6*a* to 6*c* while the other second through holes 14*d* to 14*f* for holding the fourth to sixth ink tubes ink tubes 10*d* to 10*f* have their lower openings located closer to the ink cartridges 16 (the left side in FIG. 1) than the corresponding ink dispensing inlets 6*d* to 6*f*. The details will be described later.

Also, the other second through holes 14*d* to 14*f* are inclined with their upper openings located closer to the ink cartridges 16 than their lower openings. This allows the three, fourth to sixth, ink tubes 10*d* to 10*f* held in the second through holes 14*d* to 14*f* to remain tilted towards the ink cartridges 16. Accordingly, the fourth to sixth ink tubes 10*d* to 10*f* can span at a lower position without being bent, thus contributing to the minimum height of the main body 2.

Moreover, as shown in FIG. 1, the three second through holes 14*a* to 14*c* for holding the first to third ink tubes 10*a* to 10*c* of the tube group 10A are aligned along an imaginary line substantially in parallel with the first direction (the vertical direction in FIG. 1) and specifically biased from the center in the width direction (the horizontal direction in FIG. 1) of the second tube holder 12 as being located further from the ink cartridges 16 (the right side in FIG. 1). Similarly, the other three second through holes 14*d* to 14*f* for holding the fourth to sixth ink tubes 10*d* to 10*f* of the tube group 10B are aligned along an imaginary line substantially in parallel with the first direction (the vertical direction in FIG. 1) and specifically biased from the center in the width direction (the horizontal direction in FIG. 1) of the second tube holder 12 as being located closer to the ink cartridges 16 (the left side in FIG. 1). This allows the two tube groups 10A and 10B to be spaced from each other. Accordingly, the two tube groups 10A and 10B can be prevented from interfering with one another, hence suffering from no physical injury and permitting no fracture of the meniscus.

Figure 2:
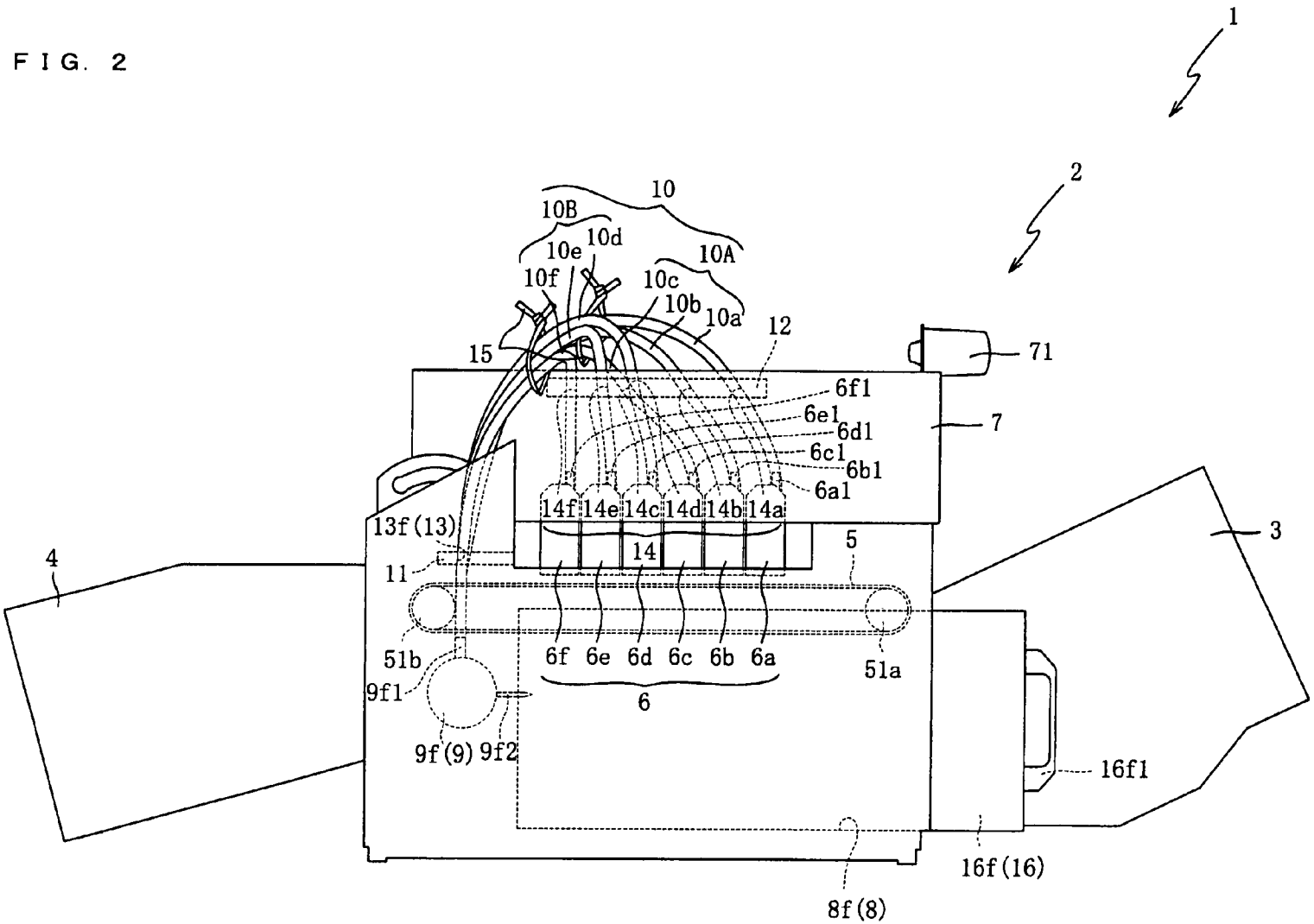
FIG. 2 is a side view of the ink jet recording apparatus with its head unit remaining closed.
Figure 3:
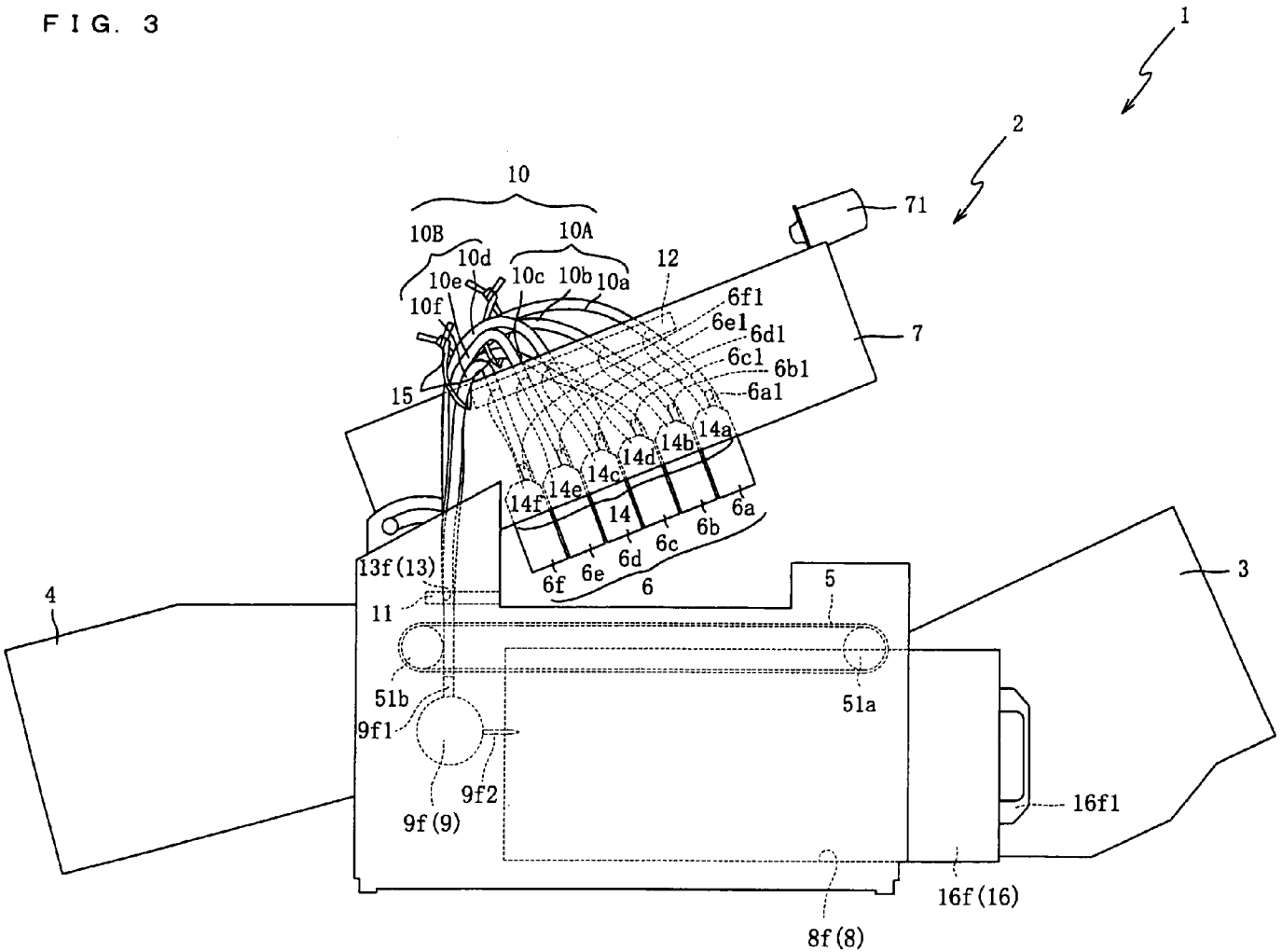
FIG. 3 is a side view of the ink jet recording apparatus with its head unit being opened.

The turning movement of the head unit 7 will now be described referring to FIGS. 2 and 3. FIG. 2 is a side view of the ink jet recording apparatus 1 with its head unit 7 being closed. FIG. 3 is a side view of the ink jet recording apparatus 1 with its head unit 7 being opened.

As shown in FIG. 2, the head unit 7 is disposed to face the conveyance belt 5 when it is closed. The head unit 7 has a handle 71 provided thereon at the upstream side (the right side in FIG. 2) in the direction of conveying the recording medium and is pivotably supported at the downstream side (the left side in FIG. 2) by the main body 2. Also as shown in FIG. 3, the head unit 7 can be turned upwardly (the upper side in FIG. 3) together with the recording heads 6 mounted to the head unit 7. With the head unit 7 turned upwardly, the jamming process can be conducted with much ease.

The second through holes 14*a* to 14*c* provided in the second tube holder 12 are also inclined with their upper openings (the upper side in FIG. 1) located closer (the left side in FIG. 2) to the intersecting point O (See FIG. 1) than their lower openings (the lower side in FIG. 1). This allows the three, first to third, ink tubes 10*a* to 10*c* held in the second through holes 14*a* to 14*c* to remain tilted towards the inserting point O (the center side of the turning movement). Accordingly, the first to third ink tubes 10*a* to 10*c* can span at a lower position without being bent, thus contributing to the minimum height of the main body 2.

Also, the second through holes 14*a* to 14*c* are inclined with their upper openings located closer to the intersecting point O (at the center of the turning movement) than their lower openings in this embodiment but not intended to be so limited. The second through holes 14*a* to 14*c* may be inclined with their upper openings located on an imaginary line which extends between the second through holes 14*a* to 14*c* and the first through holes 13*a* to 13*c*. This allows the first to third ink tubes 10*a* to 10*c* held in the second through holes 14*a* to 14*c* to be tilted towards the first through holes 13*a* to 13*c* and thus span at a lower position without being bent, thus contributing to the minimum height of the main body 2. Alternatively, the other three second through holes 14*d* to 14*f* may be arranged in the same manner.

The inner diameter of the second through holes 14*a* to 14*f* is greater than the outer diameter of the ink tubes 10*a* to 10*f*. This allows the ink tubes 10*a* to 10*f* to be held with a margin of play in the corresponding second through holes 14*a* to 14*f* as their outer walls remain slightly spaced from the inner walls at the second through holes 14*a* to 14*f* of the second tube holder 12. Accordingly, the ink tubes 10*a* to 10*f* can be prevented from any external over-stress while remaining free in the second through holes 14*a* to 14*f*.

Figure 4:
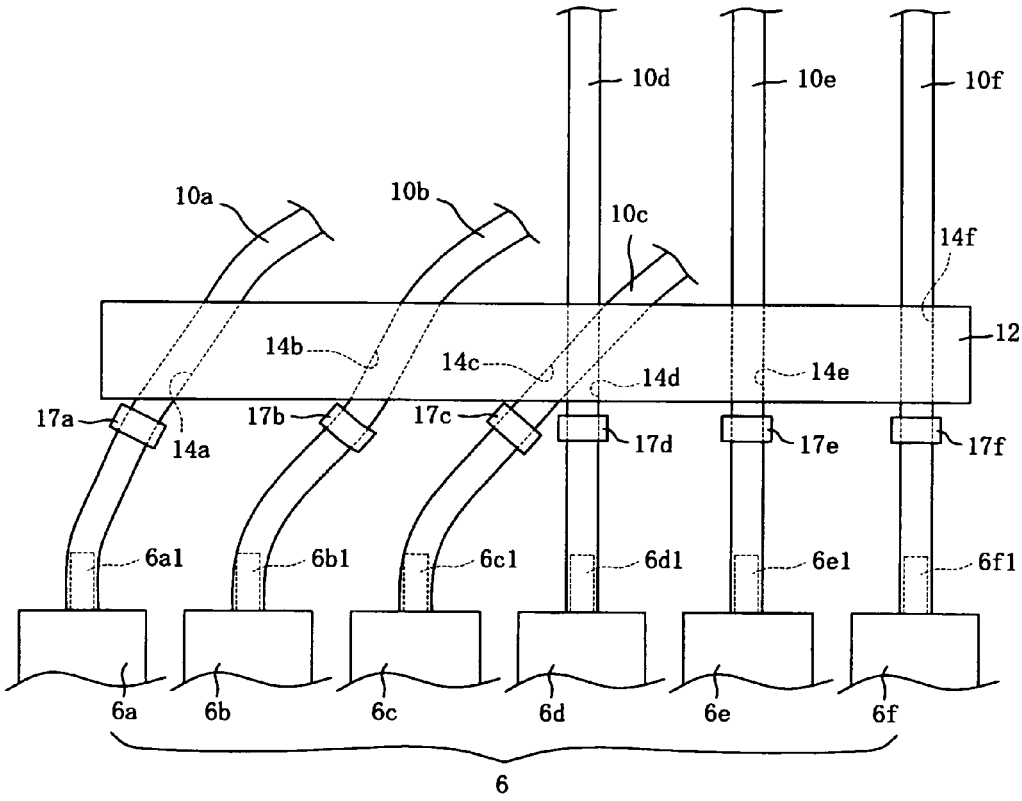
FIG. 4 is an enlarged view of a second tube holder.

The second tube holder 12 will now be described in more detail, referring to FIG. 4. FIG. 4 is an enlarged view of the second tube holder 12. The ink tubes 10 and the recording heads 6 are shown at their main portions.

As the ink dispensing inlets 6*a*1 to 6*f*1 of a hollow tubular shape extend upwardly (the upper side in FIG. 4) from their respective recording heads 6*a* to 6*f*, the ink tubes 10*a* to 10*f* are fitted onto the ink dispensing inlets 6*a*1 to 6*f*1 respectively.

The second through hole 14*a* is located with its lower opening (the lower side in FIG. 4) substantially at the center between the first ink dispensing inlet 6a1 and the second ink dispensing inlet 6b1. This allows the first ink tube 10a to be connected with the first ink dispensing inlet 6a1 at a moderate degree of the inclination as compared with when the lower opening of the second through hole 14a is biased from the center between the first ink dispensing inlet 6a1 and the second ink dispensing inlet 6b1 towards the second ink dispensing inlet 6b1 (the right side in FIG. 4). As the result, the first ink dispensing inlet 6a1 can receive a minimum of external stress and thus be protected from any physical injury. As shown in FIG. 4, the other second through holes 14b and 14c are arranged in the same manner. Accordingly, the two, second and third, ink tubes 10b and 10c can be connected to the corresponding ink dispensing inlets 6b1 and 6c1 at a moderate degree of the inclination.

Each of stoppers 17 (17a to 17f) is provided between the ink dispensing inlet 6 and the second tube holder 12 as securely fitted onto the corresponding ink tube 10. The outer diameter of the stoppers 17a to 17f is greater than the inner diameter of the second through holes 14a to 14f. This inhibits the ink tubes 10a to 10f from being displaced and overstressed in the second through holes 14a to 14f.

The second embodiment will be described referring to FIG. 5. The second embodiment is differentiated from the first embodiment by the fact that the communication between the six ink dispensing outlets 9a1 to 9f1 and the six ink dispensing inlets 6a1 to 6f1 is implemented by six modified ink tubes 110a to 110f. Although the ink tubes 10a to 10f are bound to two three-tube groups in the first embodiment, they are grouped in pairs in the second embodiment. The other arrangements are identical to those of the first embodiment. Like components are hence denoted by like numerals as those of the first embodiment and will be explained in no more detail.

Figure 5:
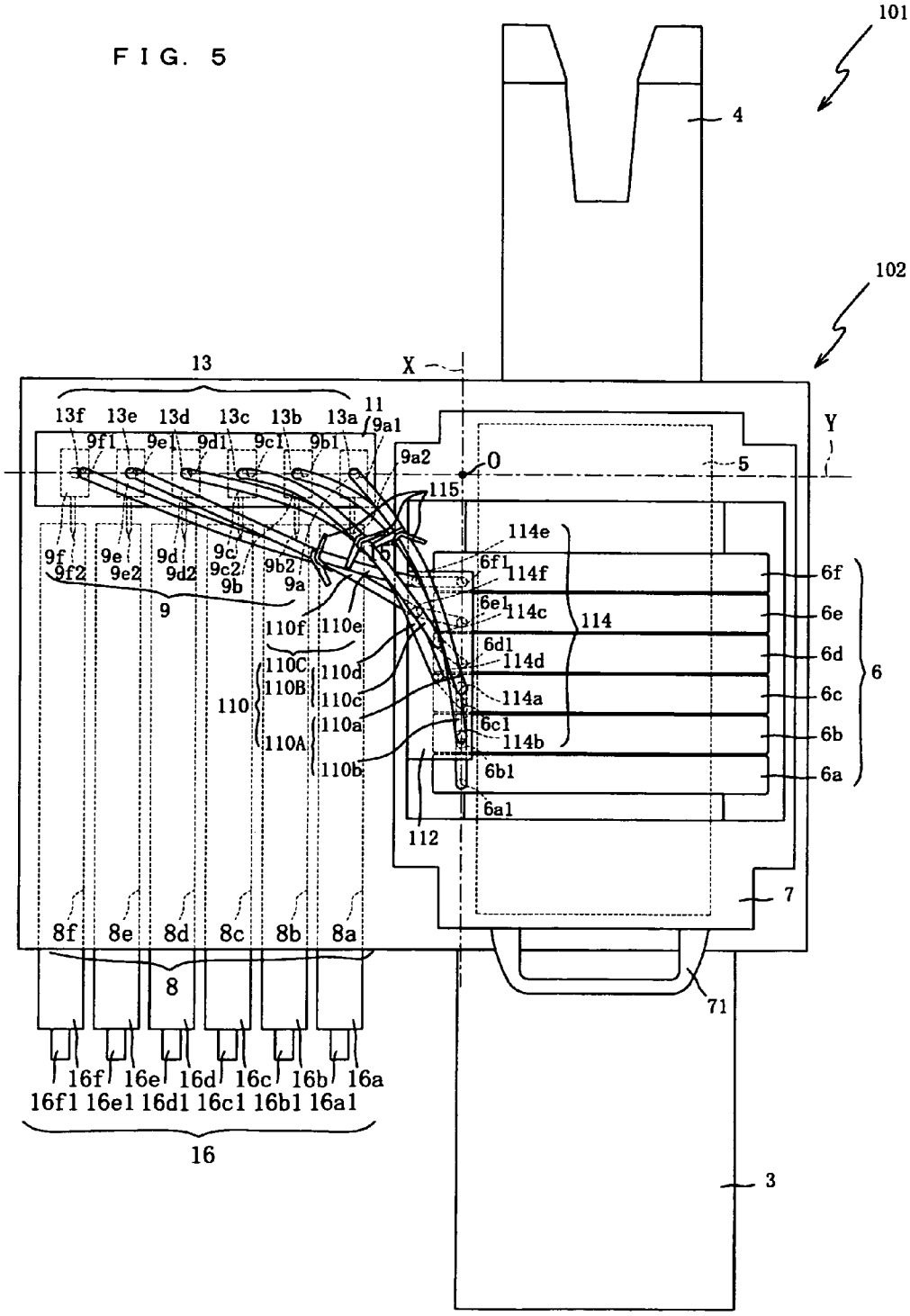
FIG. 5 is a top view of an ink jet recording apparatus according to the second embodiment.

FIG. 5 is a top view of an ink jet recording apparatus 101 according to the second embodiment.

The ink tubes 110 are provided for feeding the ink from the ink cartridges 16 to the corresponding recording heads 6.

More particularly, as shown-in FIG. 5, the first ink tube 110a is arranged to communicate between the first ink dispensing outlet 9a1 and the second ink dispensing inlet 6b1 while the second ink tube 110b communicates between the second ink dispensing outlet 9b1 and the first ink dispensing inlet 6a1. Then, the first and second ink tubes 110a and 110b are bound by a binder 115 to form a tube group 110A.

Similarly, the third ink tube 110c is arranged to communicate between the third ink dispensing outlet 9c1 and the fourth ink dispensing inlet 6d1 while the fourth ink tube 110d communicates between the fourth ink dispensing outlet 9d1 and the third ink dispensing inlet 6c1. Then, the third and fourth ink tubes 110c and 110d are bound to form a tube group 110B.

Also, the fifth ink tube 110e is arranged to communicate between the fifth ink dispensing outlet 9e1 and the sixth ink dispensing inlet 6f1 while the sixth ink tube 110f communicates between the sixth ink dispensing outlet 9f1 and the fifth ink dispensing inlet 6e1. Then, the fifth and sixth ink tubes 110e and 110f are bound to form a tube group 110C.

While the ink dispensing outlets 9a1, 9b1, 9c1, 9d1, 9e1, and 9f1 are communicated with the ink dispensing inlets 6b1, 6a1, 6d1, 6c1, 6f1, and 6e1 respectively, the ink tubes 110 in the three tube groups 110A, 110B, and 110C remain not interfered with one another. Accordingly, this prevents the lower ink tube 110 (the far side along the vertical to the sheet surface of FIG. 5) from pushing up the upper ink tube 110 (the near side along the vertical to the sheet surface of FIG. 5) when the head unit 7 is turned up when the head unit 7 is turned up. Accordingly, each of the ink tubes 110 can be prevented from detaching from the ink dispensing outlet 9 or the ink dispensing inlet 6.

While the ink dispensing outlets 9a1, 9b1, 9c1, 9d1, 9e1, and 9f1 are communicated to the ink dispensing inlets 6b1, 6a1, 6d1, 6c1, 6f1, and 6e1 respectively by the ink tubes 110 of the three tube groups 110A, 110B, and 110C, their communication is defined, similar to the first embodiment, by one of the ink dispensing inlets 6a1 to 6f1 communicated with the corresponding ink dispersing outlet 9 remaining located further from the intersecting point O than the another ink dispersing inlet 6 communicated with the corresponding ink dispensing outlet 9 which is distanced further from the intersecting point O than the ink dispensing outlet 9 communicated with the one ink dispensing inlet.

For example, the second ink dispensing inlet 6b1 communicated to the first ink dispersing outlet 9a1 by the first ink tube 110a of the tube group 110A remains located further from the intersecting point O than the fourth ink dispersing inlet 6d1 communicated to the third ink dispensing outlet 9c1 by the third ink tube 110c of the tube group 110B which is distanced further from the intersecting point O than the first ink dispensing outlet 9a1.

Accordingly, as the ink tubes 110a to 110f are minimized in the difference in the length, they can be uniform in the resistance to flow. As the result, the recording heads 6a to 6f can be uniform in the shape and the location of the meniscus developed at their ink ejecting holes (not shown), hence permitting no deterioration of the image quality.

A second tube holder 112 is made of a plate member located above the ink dispensing inlets 6a1 to 6f1 (the near side along the vertical to the sheet surface of FIG. 5) and having six second through holes 114a to 114f provided therein for holding the six ink tubes 110a to 110f respectively. Since the ink tubes 110a to 110f remain held in the corresponding second through holes 114a to 114f, they are physically spaced from one another. Accordingly, the ink tubes 110a to 110f can be prevented from interfering with one another, hence suffering from no physical injury and permitting no fracture of the meniscus.

Also as shown in FIG. 5, the two second through holes 114a and 114b for holding the first and second ink tubes 110a and 110b of the tube group 110A are aligned along an imaginary line substantially in parallel with the first direction (the vertical direction in FIG. 5) and specifically biased from the center in the width direction (the horizontal direction in FIG. 5) of the second tube holder 112 as being located further from the ink cartridges 16 (the right side in FIG. 5).

Similarly, the two second through holes 114c and 114d for holding the third and fourth ink tubes 110c and 110d of the tube group 110B are aligned along an imaginary line substantially in parallel with the first direction and specifically disposed at the center in the width direction of the second tube holder 112.

Furthermore, the two second through holes 114e and 114f for holding the fifth and sixth ink tubes 110e and 110f of the tube group 110C are aligned along an imaginary line substantially in parallel with the first direction and specifically biased from the center in the width direction of the second tube holder 112 as being located closer to the ink cartridges 16 (the left side in FIG. 5).

Since the second through holes 114a to 114f are disposed in the above manner, the three tube groups 110A, 110B, and 110C can be spaced from one another and thus prevented from interfering with one another, hence allowing the ink tubes 110 to stay free from physical injury and fracture of the meniscus.

Although the configuration has been described and illustrated on the basis of the embodiments, it can be readily understood that it is not limited to the above-mentioned embodiments, and numerous modifications and variations can be devised without departing from the scope.

The cartridge loading units 8*a* to 8*f* in the embodiments are provided with their openings at the front side (the near side) of the main body 2 from which the corresponding ink cartridges 16*a* to 16*f* are loaded. Alternatively, the openings of the cartridge loading units 8*a* to 8*f* may be located at the rear side of the main body 2 for loading the corresponding ink cartridges 16*a* to 16*f*. The latter case allows the loading and unloading of the ink cartridges 16*a* to 16*f* on the corresponding cartridge loading units 8*a* to 8*f* to be carried out at the rear side of the main body 2 as well as the removal of printed recording medium from the stacker 4.

Although the ink jet recording apparatuses 1 and 101 of the embodiments are illustrated with their ink tubes 10 and 110 viewed from the upper in order to understand the embodiments with ease, their main bodies 2 and 102 are actually accommodated in applicable housings.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An ink jet recording apparatus comprising:

a conveying unit for conveying a recording medium in a first direction;

a plurality of recording heads positioned to face the recording medium being conveyed by the conveying unit, each of the recording heads having a plurality of ink ejecting holes and an ink dispensing inlet provided therein from which ink is supplied;

a plurality of cartridge loading units into which corresponding ink cartridges are loaded from the outside;

a plurality of ink dispensing units provided corresponding to the cartridge loading units, each of the ink dispensing units having an ink dispensing outlet for dispensing the ink from the corresponding ink cartridge loaded in the cartridge loading unit; and a plurality of ink tubes for connecting the ink dispensing outlets and the ink dispensing inlets respectively, wherein the recording heads are arranged so that their ink dispensing inlets are aligned in the first direction, the cartridge loading units are aligned in a second direction, which extends substantially at a right angle to the first direction, so that their corresponding ink cartridges are inserted and loaded in the first direction, the ink dispensing units are arranged with their ink dispensing outlets aligned in the second direction, and the ink dispensing inlets communicated with the corresponding ink dispensing outlets are arranged so that one ink dispensing inlet is located further from an intersecting point between a line along which the ink dispensing inlets are aligned and a line along which the ink dispensing outlets are aligned than the another ink dispensing inlet communicated with the ink dispensing outlet which is distanced further from the intersecting point than the ink dispensing outlet communicated with the one ink dispensing inlet.

2. The ink jet recording apparatus according to claim 1, wherein the number of the ink dispensing inlets or the ink dispensing outlets is n (n being a natural number of two or more) and an ink dispensing outlet located at the x-th closest (x being an natural number) to the intersecting point among the ink dispensing outlets is communicated with an ink dispensing inlet which is located at the (n−x+1)th closest to the intersecting point among the ink dispensing inlets.

3. The ink jet recording apparatus according to claim 1, further comprising:

a recording medium supply unit provided adjacent to the upstream end of the conveying unit for supplying the recording medium on the conveying unit in the first direction, wherein the recording medium supply unit is arranged so that the recording medium can be handled from the outside, and the ink cartridges are loaded into the corresponding cartridge loading units from the same side from which the recording medium is handled.

4. The ink jet recording apparatus according to claim 1, further comprising:

binders, each arranged for bonding at least adjacent two or more of the ink tubes.

5. The ink jet recording apparatus according to claim 4, wherein when the ink tubes are bound by the binder to form a tube group, one of the ink tubes of the tube group communicated with one of the ink dispensing inlets is spanned lower than another ink tube of the tube group communicated with another ink dispensing inlet which is located farther from the intersecting point than the one of the ink dispensing inlets.

6. The ink jet recording apparatus according to claim 1, further comprising:

a first tube holder provided above the ink dispensing outlets, wherein the first tube holder has the same number of first through holes provided therein as the number of the ink tubes for holding the ink tubes.

7. The ink jet recording apparatus according to claim 1, further comprising:

a head unit on which the recording heads are mounted, wherein the head unit is arranged so as to be turnable about the shaft which extends in the second direction and is disposed at one of the two ends of the head unit in the first direction which is closer to the ink dispensing outlets.

8. The ink jet recording apparatus according to claim 7, wherein one of the ink tubes communicated with one of the ink dispensing inlets is spanned lower than another ink tube communicated with another ink dispensing inlet which is located farther from the intersecting point than the one of the ink dispensing inlets.

9. The ink jet recording apparatus according to claim 7, further comprising:

a second tube holder fixedly mounted to the head unit as located above the ink dispensing inlets, wherein the second tube holder has the same number of second through holes provided therein as the number of the ink tubes for holding the ink tubes, and at least one of the second through holes which is located at the closest to the intersecting point is located substantially directly above the ink dispensing inlet at the closest to the intersecting point while another second through hole which is distanced at the furthest from the intersecting point is located closer to the intersecting point than the ink dispensing inlet which is distanced at the furthest from the intersecting point.

10. The ink jet recording apparatus according to claim 9, wherein at least one of the second through holes which is located at the furthest from the intersecting point is bored slantly with its upper opening located closer to the intersecting point than its lower opening.

11. The ink jet recording apparatus according to claim 9, wherein the inner diameter of the second through holes is greater than the outer diameter of the ink tubes.

12. The ink jet recording apparatus according to claim 11, further comprising:

a plurality of stoppers provided for securing the corresponding ink tubes between the ink dispensing inlets and the second tube holder, wherein the stopper is greater than the inner diameter of the second through holes.

13. The ink jet recording apparatus according to claim 1, wherein each of the ink dispensing units is equipped with a pump for applying a pressure to dispense the ink from the ink cartridge into the corresponding ink tube.

* * * * *